US007523708B2

(12) United States Patent
Taylor

(10) Patent No.: US 7,523,708 B2
(45) Date of Patent: Apr. 28, 2009

(54) RAILROAD HOPPER CAR TRANSVERSE DOOR ACTUATING MECHANISM

(76) Inventor: Fred J. Taylor, 6485 Rogers La., Burlington, KY (US) 41005

( * ) Notice: Subject to any disclaimer, the term of this patent is extended or adjusted under 35 U.S.C. 154(b) by 18 days.

(21) Appl. No.: 11/408,446

(22) Filed: Apr. 21, 2006

(65) Prior Publication Data

US 2006/0254456 A1 Nov. 16, 2006

Related U.S. Application Data

(60) Provisional application No. 60/673,458, filed on Apr. 21, 2005.

(51) Int. Cl.
*B61D 7/00* (2006.01)

(52) U.S. Cl. ..... 105/290; 105/248; 105/308.1

(58) Field of Classification Search ..... 105/286, 105/287, 288, 290, 289, 293, 296, 298, 299, 105/304, 240, 308.1, 310, 247, 248, 253
See application file for complete search history.

(56) References Cited

U.S. PATENT DOCUMENTS

| | | | | | |
|---|---|---|---|---|---|
| 4,688,488 | A * | 8/1987 | Adams et al. | ..... | 105/253 |
| 4,741,274 | A * | 5/1988 | Ferris et al. | ..... | 105/240 |
| 4,766,820 | A * | 8/1988 | Ritter et al. | ..... | 105/240 |
| 5,249,531 | A * | 10/1993 | Taylor | ..... | 105/290 |
| 5,823,118 | A * | 10/1998 | Manstrom | ..... | 105/284 |
| 6,405,658 | B1 * | 6/2002 | Taylor | ..... | 105/286 |

* cited by examiner

*Primary Examiner*—Mark T. Le
(74) *Attorney, Agent, or Firm*—Jerrold J. Litzinger

(57) ABSTRACT

An actuating system for operating transverse doors of a railroad hopper car. The mechanism includes an operating member which is coupled to a door or doors of the car by a shaft and a linkage which couples a power source to the operating member, where the operating member rotates to move the door away from the hopper. The mechanism can operate doors which open in opposed direction with a single power source. The mechanism can be used in new car construction, and can be retrofitted onto existing hopper cars.

6 Claims, 12 Drawing Sheets

RAILROAD HOPPER CAR TRANSVERSE DOOR ACTUATING MECHANISM

CROSS REFERENCE TO RELATED APPLICATIONS

This application claims benefit from U.S. Provisional Patent Application Ser. No. 60/673,458, filed Apr. 21, 2005 which application is incorporated herein by reference.

BACKGROUND OF THE INVENTION

1. Field of the Invention

The present invention is directed in general to a device for opening the hopper doors of a railroad car, and, in particular, to a system for automatically opening and closing the hopper doors of a railroad car.

2. Description of the Related Art

A common type of railroad freight car in use today is the freight car of the type wherein the load is discharged through hoppers in the underside of the body. Such cars are generally referred to as hopper cars and are used to haul coal, phosphate and other commodities.

After hopper cars are spotted over an unloading pit, the doors of the hoppers are opened, allowing the material within the hopper to be emptied into the pit.

Hopper cars, which may be covered, are usually found with one of two hopper configurations: transverse, in which the doors closing the hoppers are oriented perpendicular to the center line of the car; or longitudinal, in which the doors closing the hoppers are oriented parallel to the center line of the car. An example of a hopper car with transverse doors is shown in U.S. Pat. No. 5,249,531, while an example of a hopper car with longitudinal doors is shown in U.S. Pat. No. 4,224,877.

Prior art references which teach operating mechanisms for opening and closing hopper doors include U.S. Pat. Nos. 3,596,609; 4,741,274; 3,187,684; 3,611,947; 3,786,764; 3,815,514; 3,818,842; 3,949,681; 4,222,334; 4,366,757; 4,601,244; 5,823,118; and 5,249,531. There are several disadvantages to the hopper door operating mechanisms described in some of the aforementioned patents. One problem is that some of the prior art mechanisms are designed such that each actuating mechanism is connected to doors from two separate hoppers. Thus, if the mechanism fails, it effects the operation of two hoppers. Another disadvantage of some of the above described hopper door mechanisms is that the operating mechanisms limit the distance of the door motion, thus limiting the open area of the car's bottom. This arrangement slows the unloading process and causes additional costs and potential damage to the car due to increased periods in thaw sheds. However, many of these systems usually require automatic operation of the doors, which requires an operating cylinder and valving.

Finally, it is often desirable to empty the contents of a railcar while the car is in motion, thus allowing the car to be emptied quicker. This method of operation also normally requires the use of expensive air cylinders and valving.

SUMMARY OF THE INVENTION

It is therefore an object of the present invention to provide an actuating mechanism which allows the discharge doors of a hopper car to open and close automatically.

It is a further object of the present invention to provide a simple automatic mechanism for actuating the discharge doors of a hopper car which can quickly empty the contents.

It is a still further object of the present invention to provide an actuating mechanism for a hopper car which can be used on transverse doors.

These and other objects of the present invention will be more readily apparent from the descriptions and drawings which follow.

DESCRIPTION OF A PREFERRED EMBODIMENT

Figure 1:
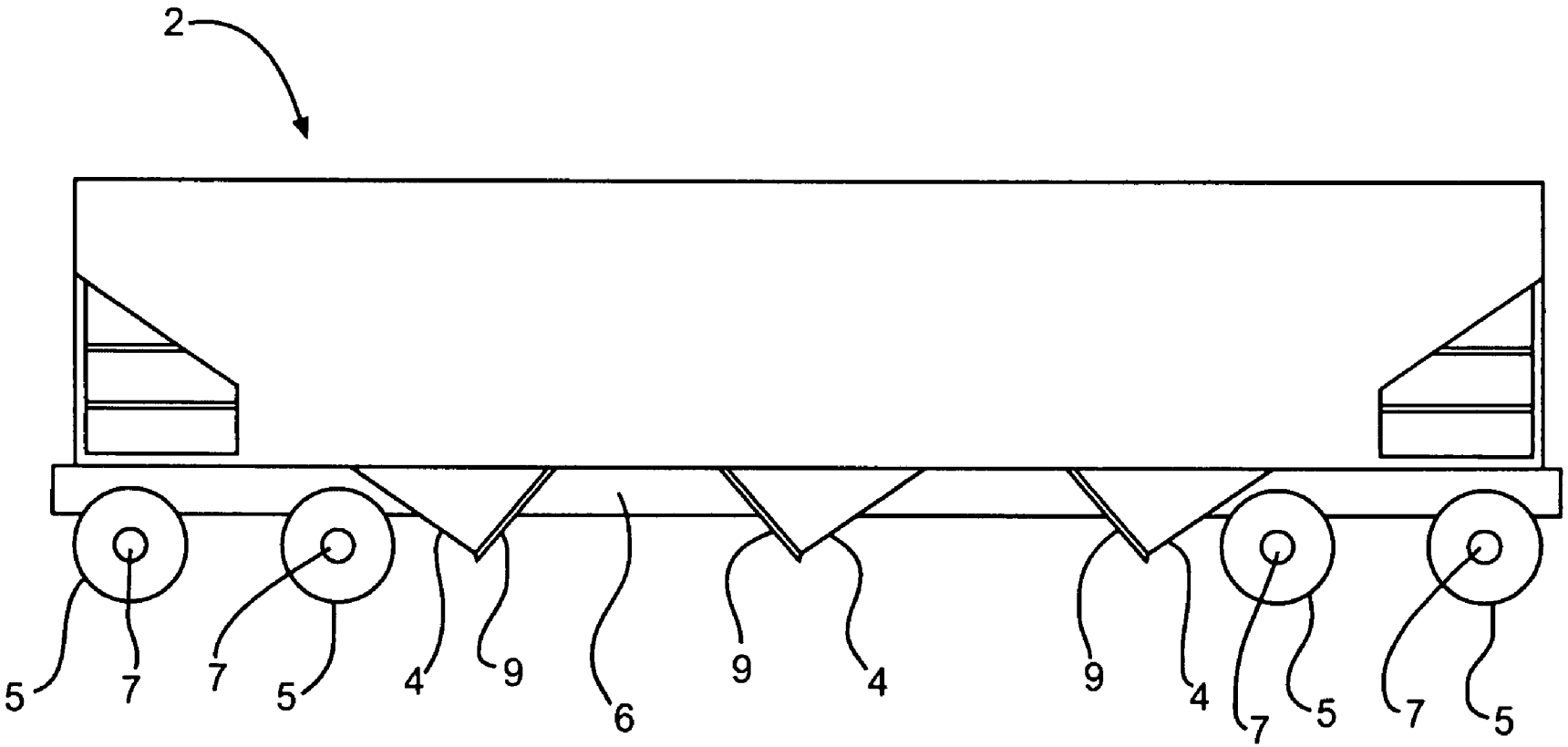
FIG. 1 is an elevational view of a standard three pocket hopper car having a single transverse door associated with each hopper which is capable of using the present invention.
Figure 2:
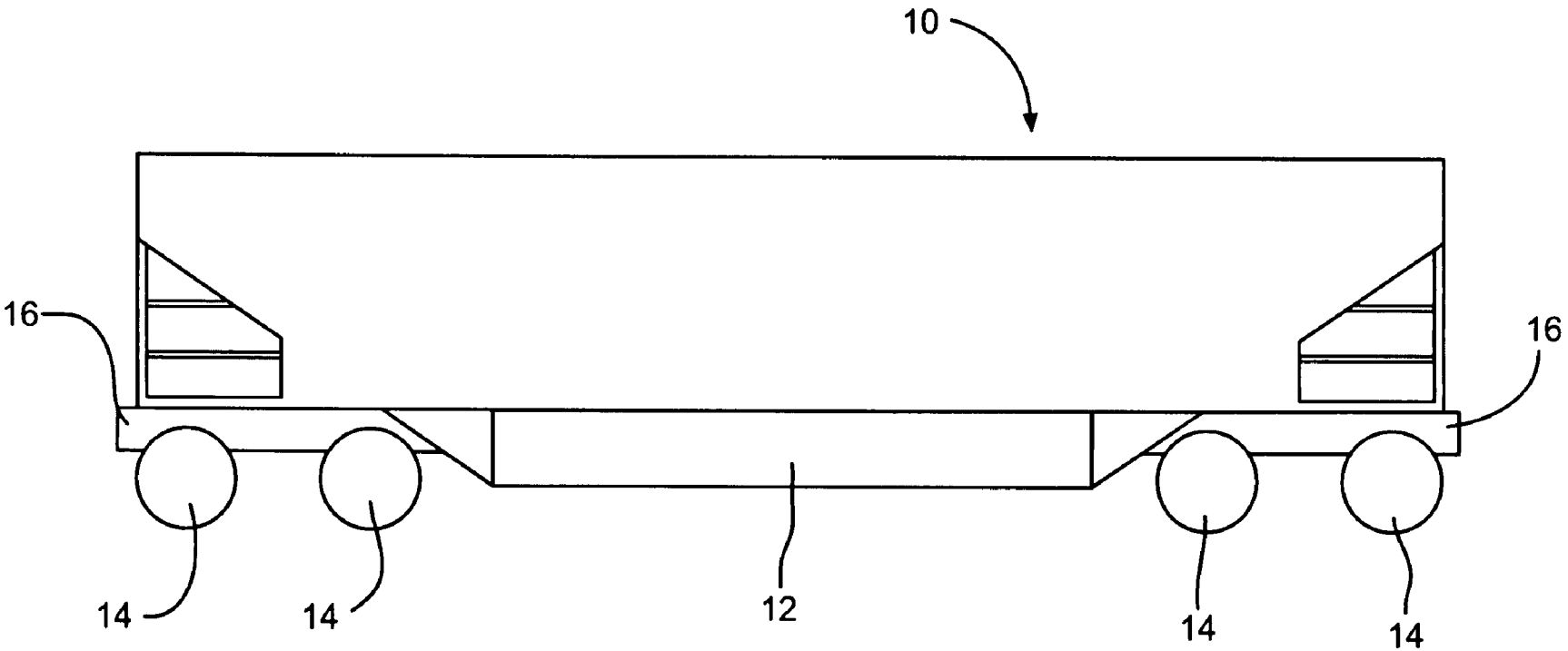
FIG. 2 is an elevational view of hopper car having a longitudinal door set which is capable of using the present invention.

FIGS. 1-2 display two different major types of hopper cars. FIG. 1 shows hopper cars using transverse doors, while FIG. 2 shows a car using longitudinal doors.

Referring now to FIG. 1, there is shown a typical three pocket railway hopper car, generally designated at 2, which may be equipped with a preferred embodiment of the present invention. Car 2 is provided with a plurality of hopper units 4, a plurality of wheels 5, and a longitudinally extending center sill 6. Wheels 5 are mounted on a series of truck axles 7. Each hopper unit 4 is provided with a door 9 which is moveable to open and close each hopper unit 4. An actuating system for this type of car is taught in U.S. patent application Ser. No. 10/863,887, filed Jun. 8, 2004, which application is incorporated herein by reference.

Referring now to FIG. 2, there is shown a typical hopper railcar, generally indicated at 10, having longitudinal doors which may be equipped with a preferred embodiment of the present invention. Car 10 is provided with a longitudinal door set 12, a plurality of wheels 14, and a longitudinally extending center sill 16. An operating system for this type of hopper car is taught in U.S. Pat. No. 6,955,126, issued Oct. 28, 2005, which patent is incorporated herein by reference. Although the system taught in this patent teaches the operation of a single pair of doors, the mechanism can be used to open multiple sets of longitudinal doors.

Figure 3A:
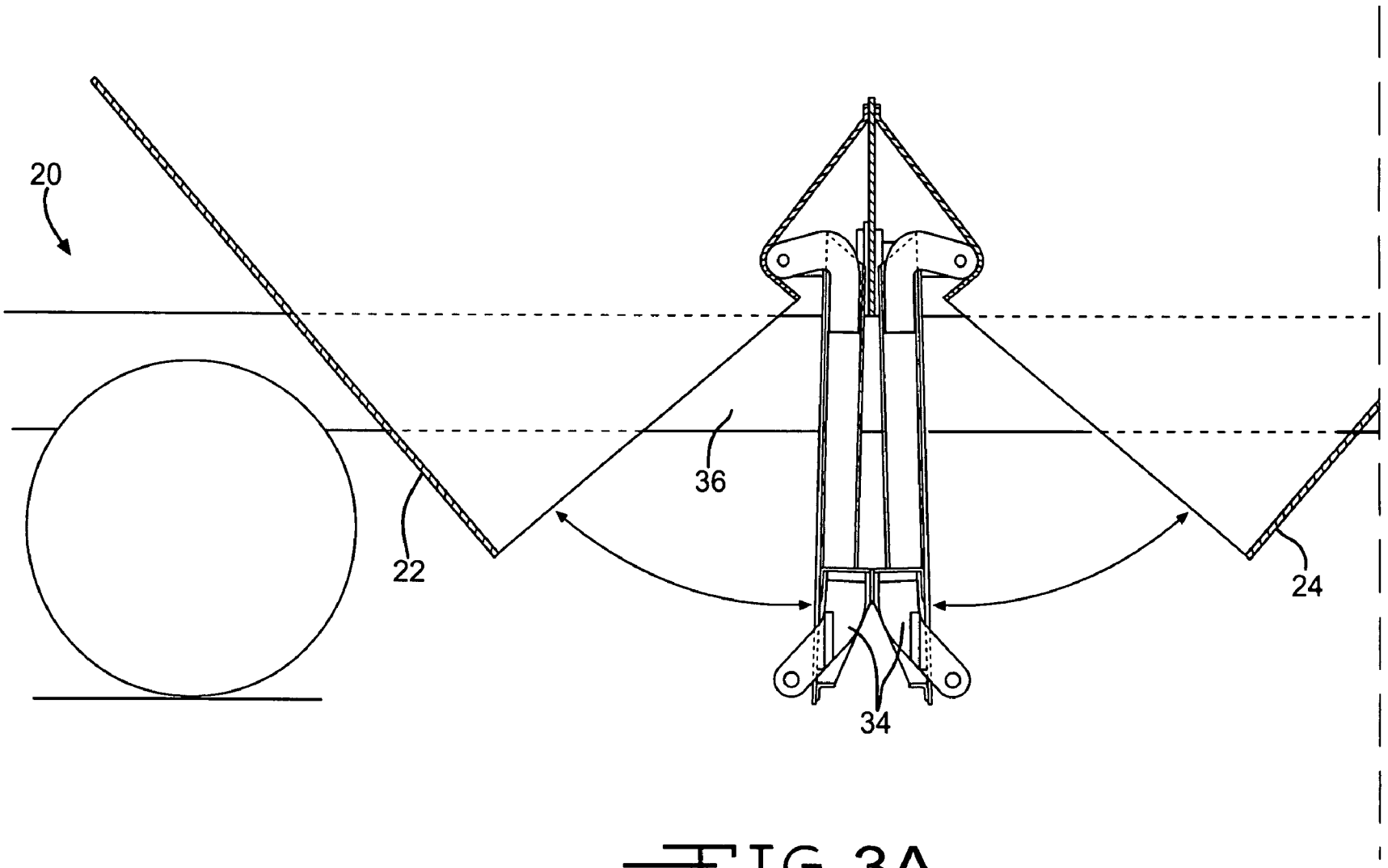
FIGS. 3A-C, taken together, show a plan view of a six pocket railroad car using the present invention.
Figure 3B:
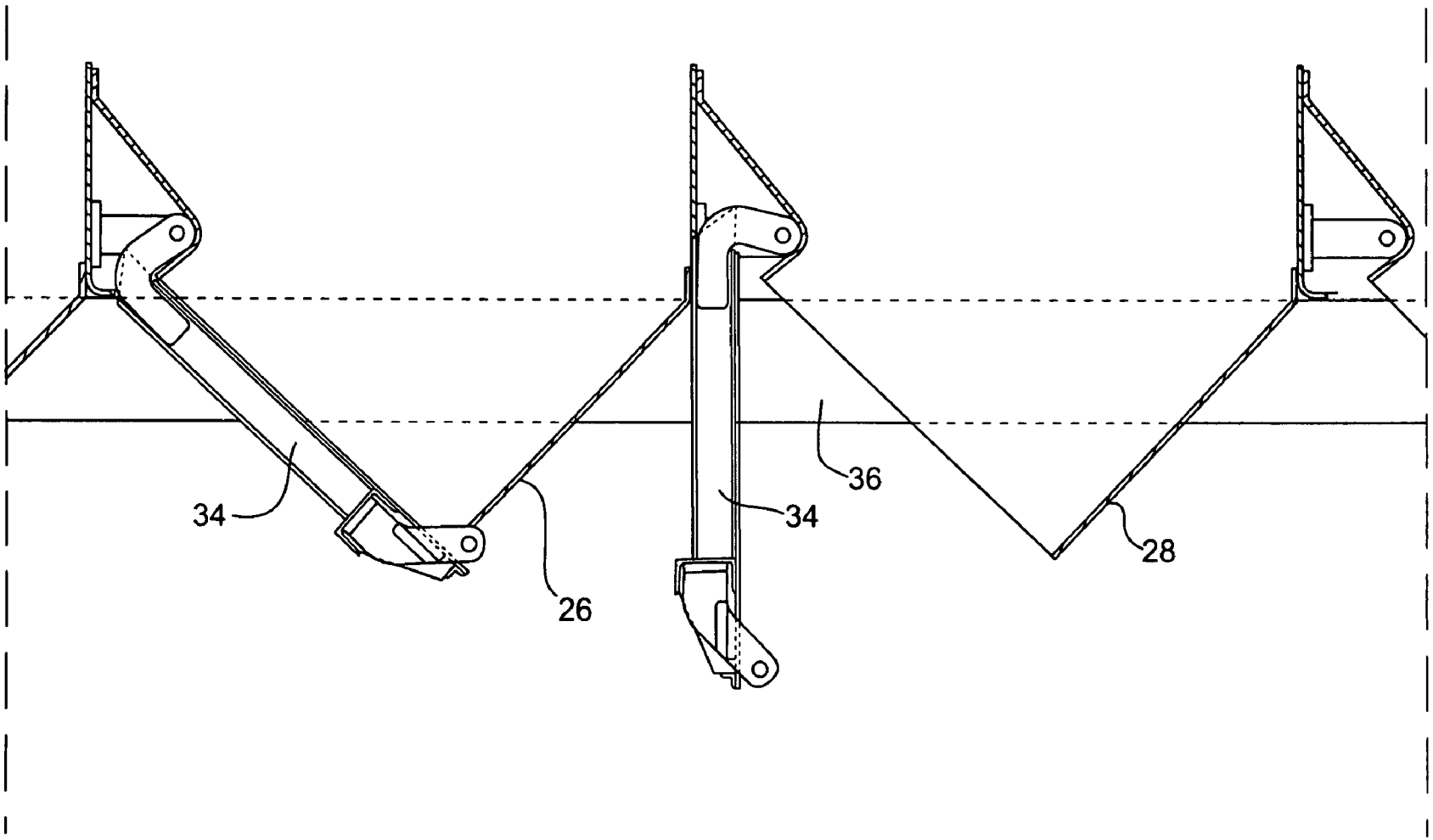
Figure 3C:
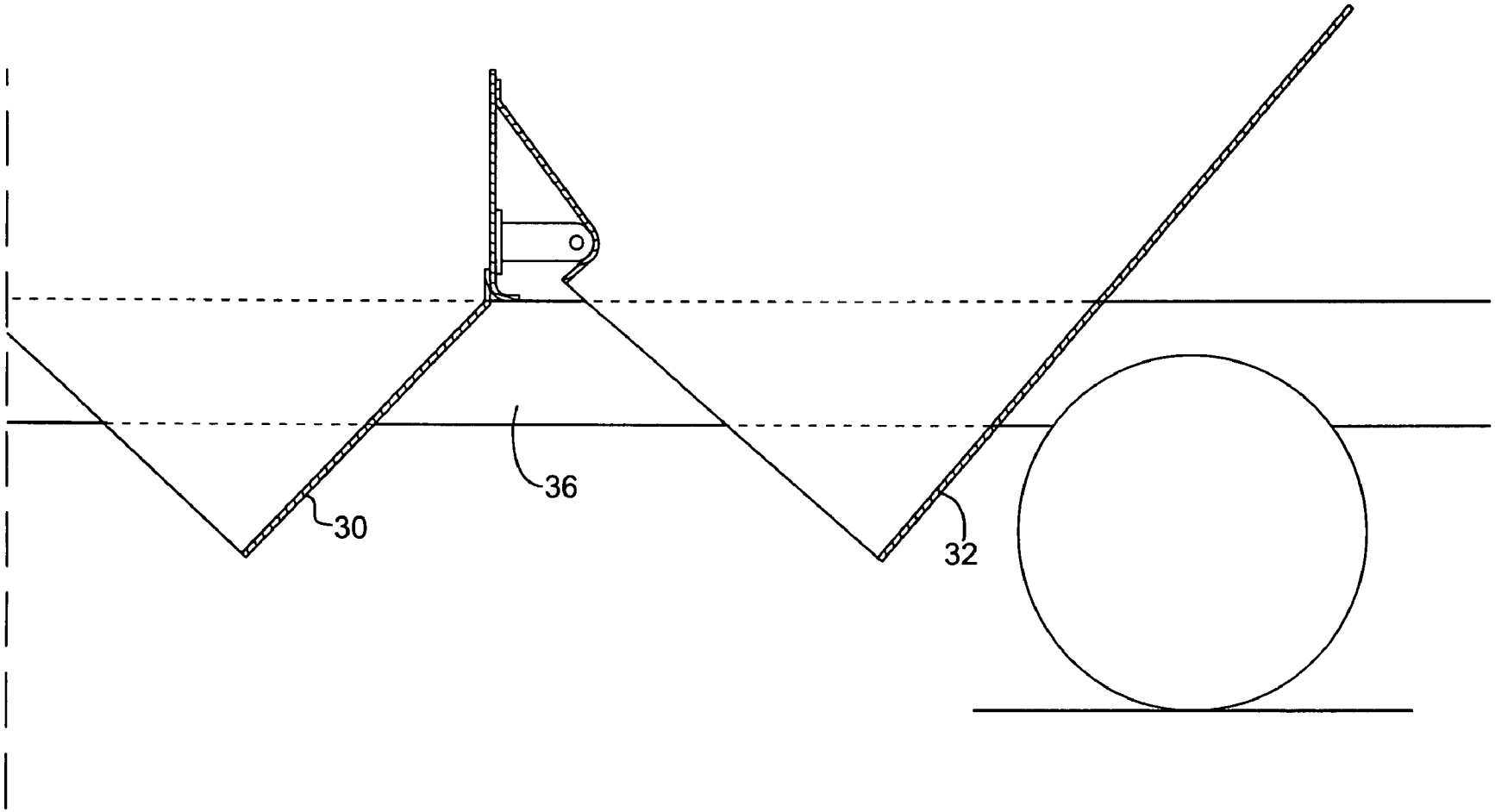

FIGS. 3A-C, taken together, show a typical six pocket hopper car, designated at 20. Hoppers 22, 24, 26, 28, 30, 32 are shown, with door 34 of hopper 22 operating in a different direction than doors 34 for the other hoppers. Doors 34 for hoppers 22, 24 are shown in the fully open position, while door 34 for hopper 26 is shown in the closed position. Door 34 for hopper 28 is shown in the open position, while the doors for hoppers 30, 32 are not shown in FIG. 3C. The center sill 36 can be seen in FIGS. 3A-C.

Figure 4A:
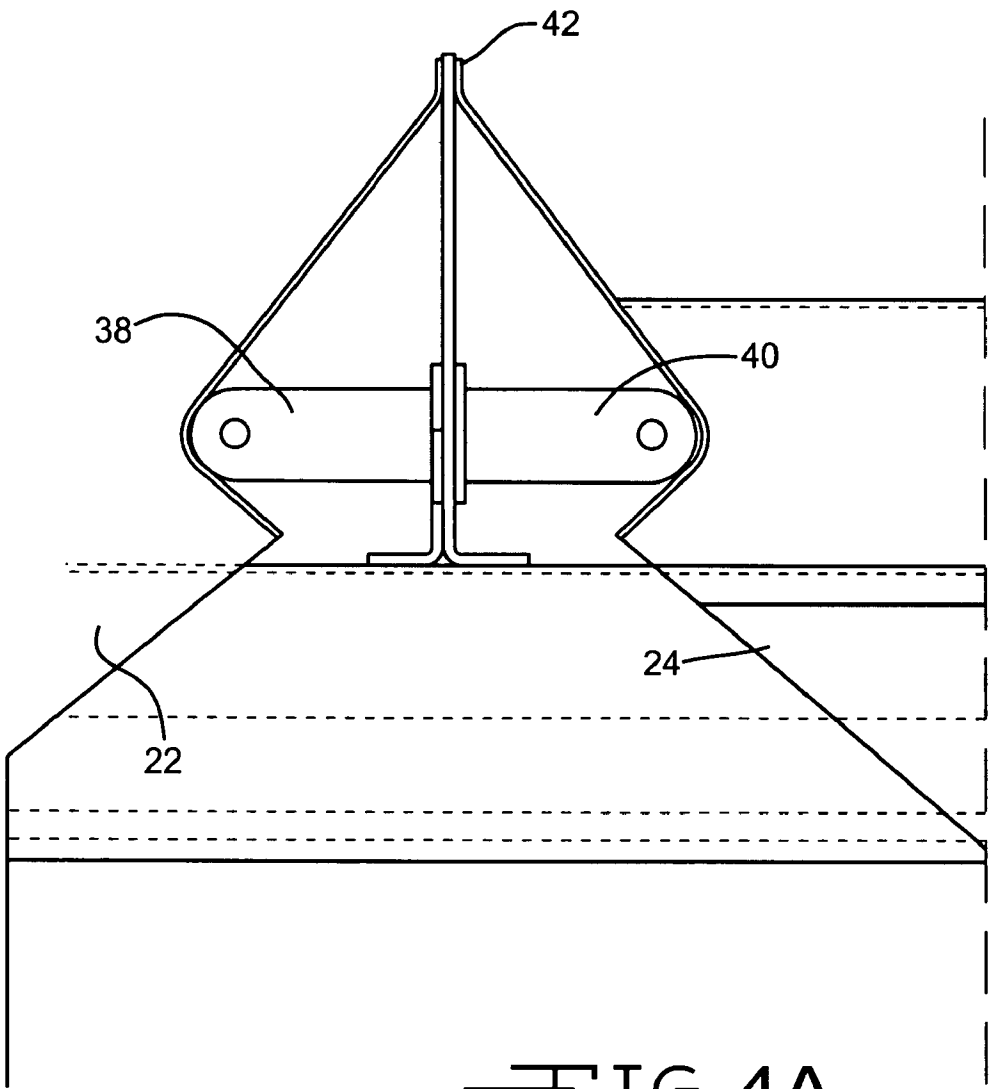
FIGS. 4A-B, taken together, show a partial plan view including transverse ridges and door hinge connectors.
Figure 4B:
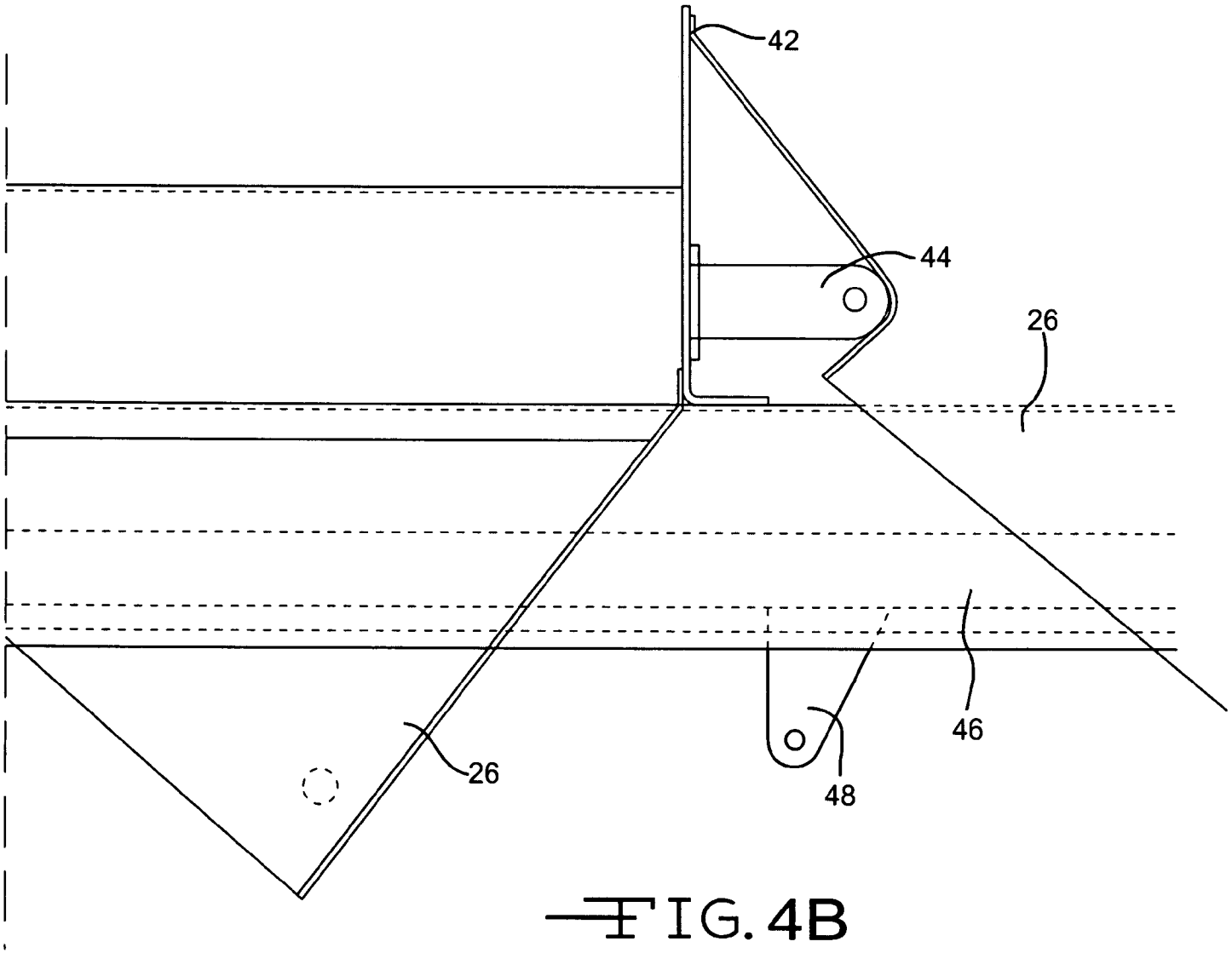

FIGS. 4A-B show the connecting points for doors 34 for hoppers 22, 24 and 26. Door 34 for hopper 22 mounts to link 38, while door 34 for hopper 24 mounts to link 40. These links are covered by a transverse ridge 42. Door 34 closing hopper 26 mounts to link 44, which is shown covered by another transverse ridge 42.

The actuating beam for opening the doors can be seen at 46 while an actuating beam fulcrum 48 can be seen in FIG. 4B, which fulcrum connects to the mechanism for operating the door for hopper 26.

Figure 5:
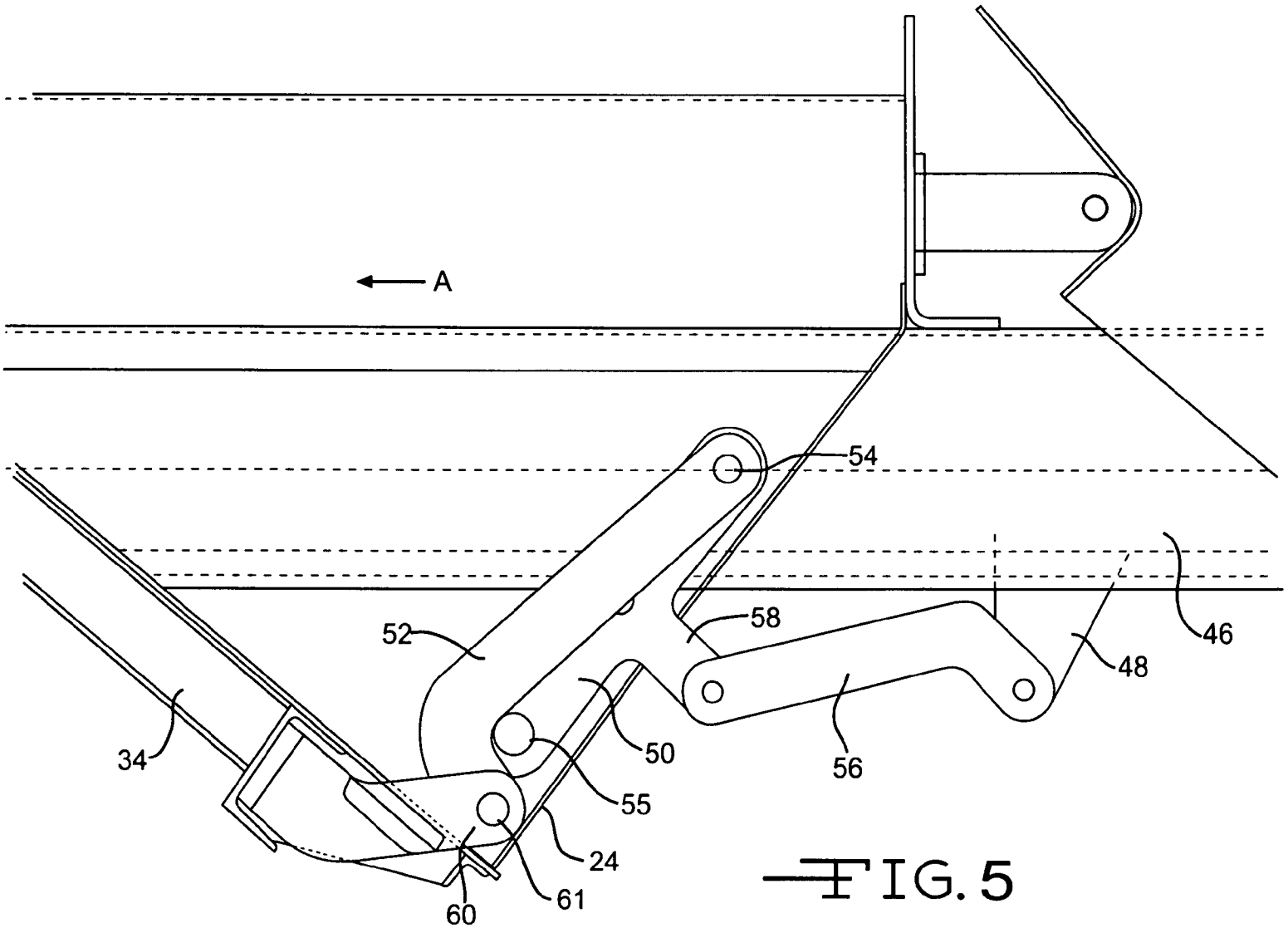
FIG. 5 is a plan view of the operating mechanism of the present invention on one door shown in the closed position.
Figure 6:
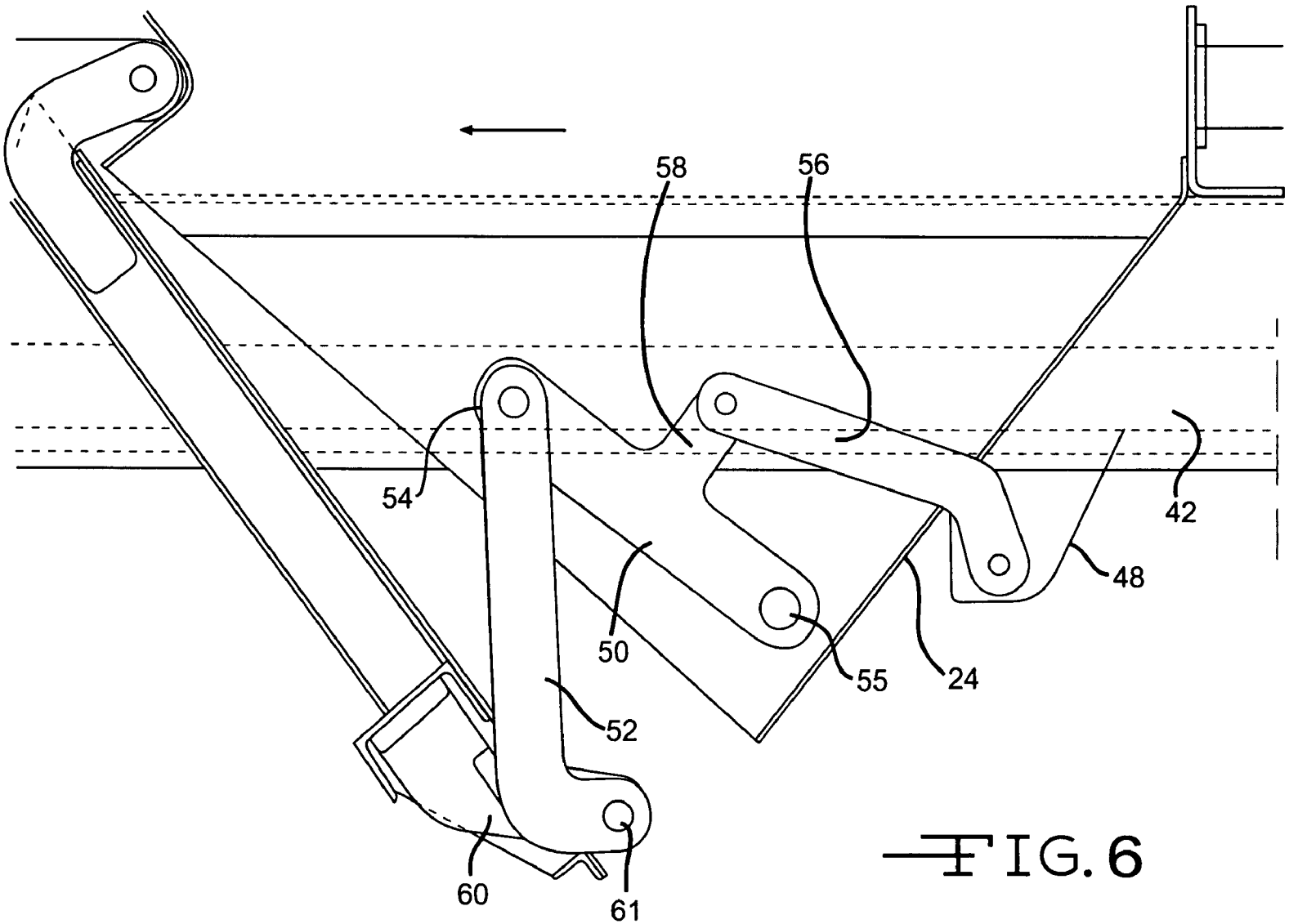
FIG. 6 is a plan view of the mechanism shown in FIG. 5 with the door shifting toward the open position.
Figure 7:
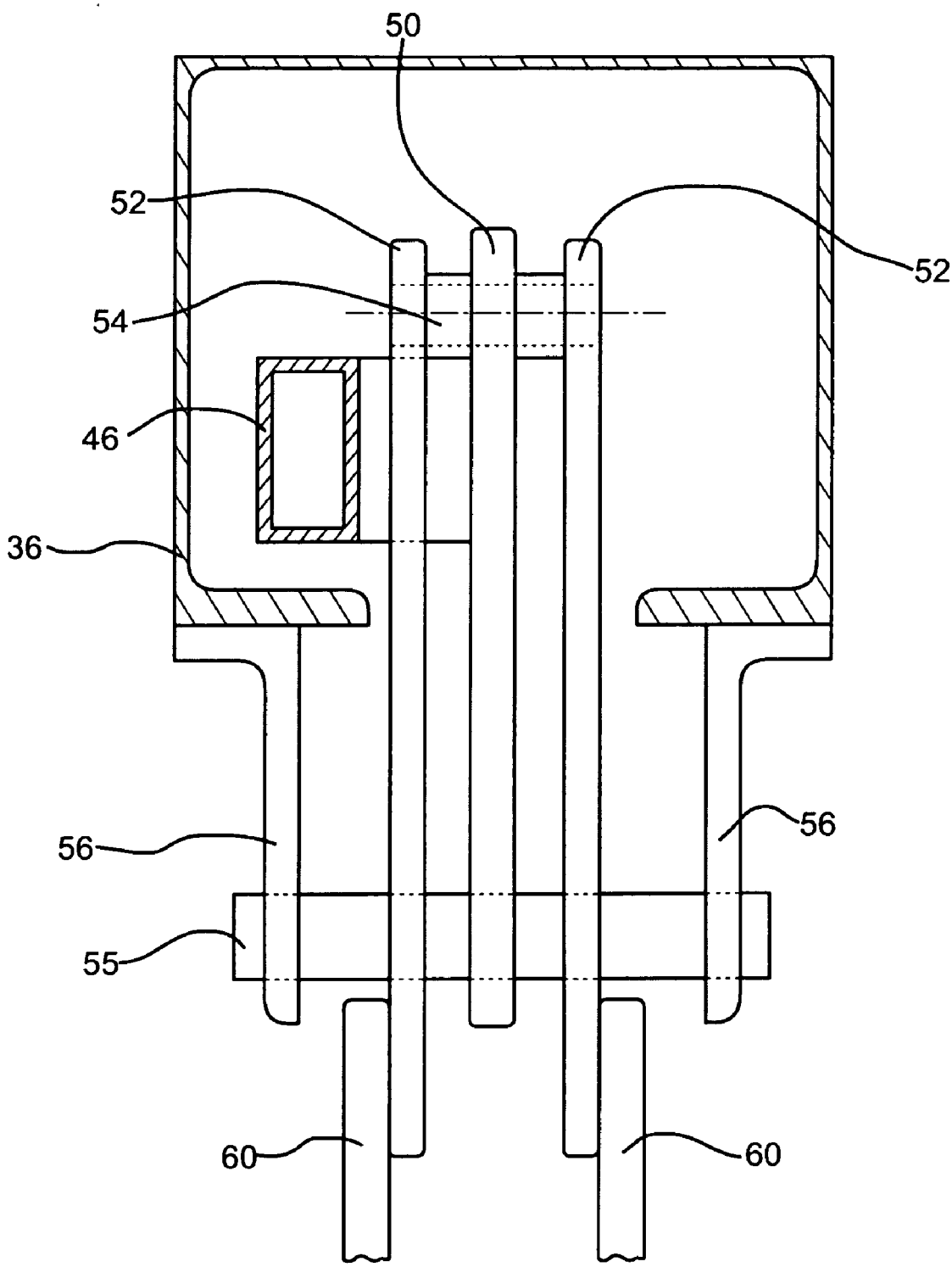
FIG. 7 is a cross-sectional view taken through the center sill.

FIG. 5 shows the door mechanism for operating the doors which shift in the same direction, which includes hoppers 24, 26, 28, 30 and 32 in the present embodiment. Door 34, shown in the closed position, is coupled to an actuating lever 50 by a pair of curved links 52 by a pin 54. The other end of lever 50 is rotatably coupled to the car 20 by a pivot pin 55 which passes through a pair of mounts 56 (FIG. 7) which are mounted on the underside of center sill 36. A curved linkage 56 is coupled between an extension 58 of lever 50 and beam fulcrum 48. The opposite ends of links 52 are rotatably coupled to a pair of extensions 60 which are connected to each door 34 at a pin 61.

Figure 8:
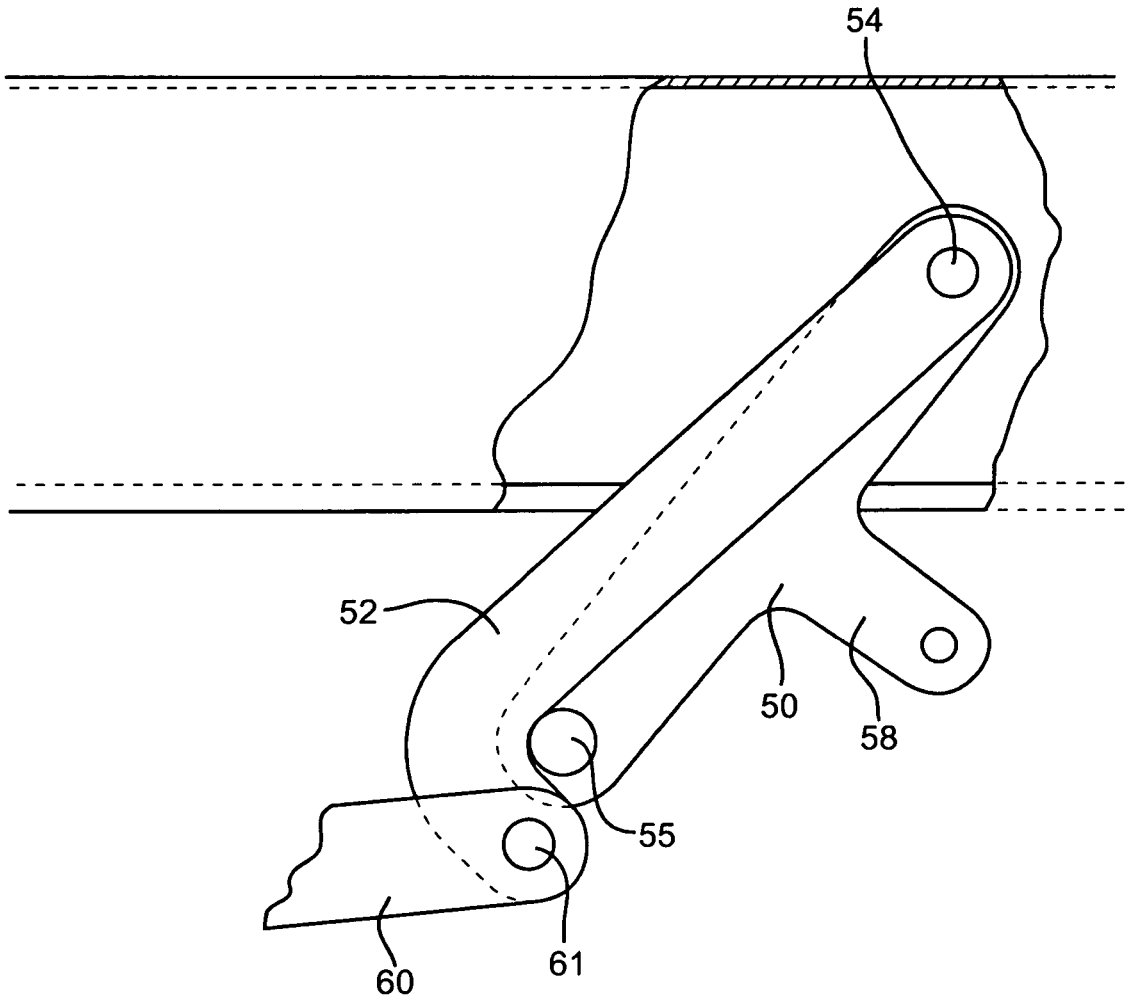
FIG. 8 is a plan view of the operating linkage of the present invention shown for one door.

To operate the door opening mechanism, actuating beam 46 is shifted in the direction shown by arrow A in FIG. 5. This causes lever 50 to rotate about pivot pin 55, causing links 52 to pass through the centerline of the mechanism, as shown in FIG. 8. Referring now to FIG. 8, as pin 61 passes through the center line between pin 55 and pin 54, the over center latch is released. This action unlatches the door mechanism causing links 52 to shift door 34 away from the hopper. Further travel of actuating beam 46 in the direction of arrow A, along with the weight of the contents of the hopper, cause door 34 to travel to its full open position as seen in FIGS. 3A-C. The closing of door 34 is accomplished by reversing the movement of actuating beam 46.

Figure 9:
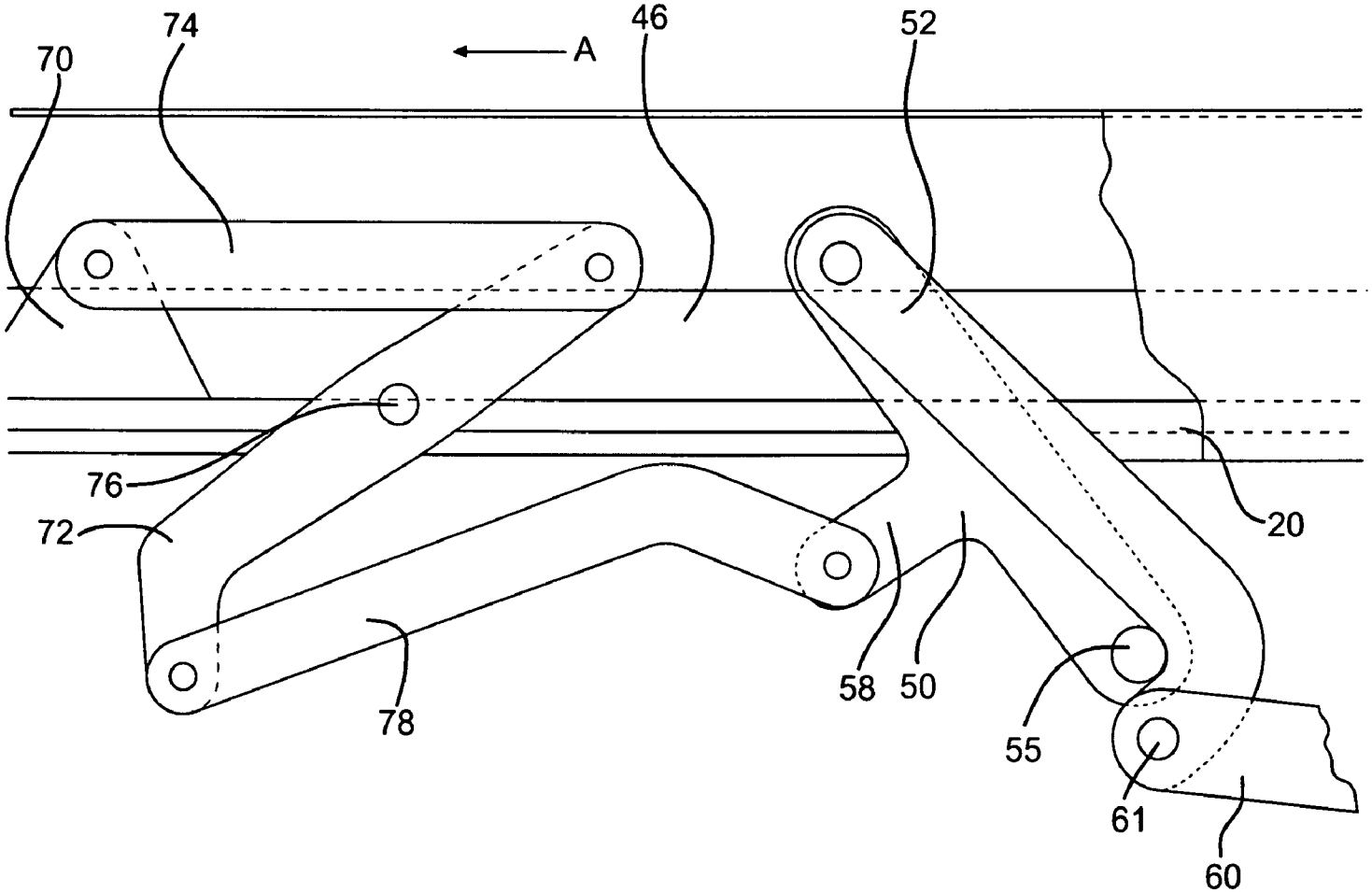
FIG. 9 is a plan view of the reversing linkage for the mechanism of the present invention.

The reversing linkage of the operating mechanism is shown in FIG. 9. An extension 70 extends upwardly from actuating beam 46 and is coupled to reversing lever 72 by a lever 74. Lever 72 is mounted for rotation on a pivot pin 76 which is affixed to car 20. The other end of reversing lever 72 is rotatably coupled to a lever 78 which is rotatably coupled to an extension 58 of actuating lever 50. Links 52 are connected between actuating lever 50 and door 34 at extension 60.

As actuating beam 46 travels in the direction of arrow A, lever 74 causes reversing lever 72 to rotate about pin 76 in a counterclockwise direction, forcing lever 78 to cause actuating lever 50 to rotate about pin 55, rotating link 52 and causing door 34 to move to the open position away from hopper 22. Further travel of actuating beam 46 in the direction of arrow A causes door 34 to open to its fully open position as shown in FIG. 3A. The closing of door 34 for hopper 22 is accomplished by reversing the travel of actuating beam 46.

When all of the doors have been shifted to the open position, the total area of discharge is approximately 140 square feet larger than any other car of this size in the market place.

In the above description, and in the claims which follow, the use of such words as "clockwise", "counterclockwise", "distal", "proximal", "forward", "rearward", "vertical", "horizontal", and the like is in conjunction with the drawings for purposes of clarity. As will be understood by one skilled in the art, the mechanisms will operate on hopper doors which open in opposite directions, and thus will use opposite terminology.

While the invention has been shown and described in terms of preferred embodiment, it will be understood that this invention is limited to this particular embodiment, and that many changes and modifications may be made without departing from the true spirit and scope of the invention as defined in the appended claims.

What is claimed is:

1. A railroad hopper car having a first end and a second end and having transverse doors for closing the hoppers, comprising:

a body;

a power source;

a plurality of hoppers along the underside of said body;

a plurality of doors situated in a transverse direction to said body for opening and closing said hoppers, said doors rotatable between a first closed position and a second open position, with at least one of said doors rotating in an opposite direction from said other doors when moving from said first closed position to said second open position;

a center sill, affixed to the underside of the hopper car, extending along the length of the car;

a plurality of operating members, each rotatably coupled to said center sill, with each operating member comprising:

a first end;

a second end rotatably coupled to said body at said center sill by a pin;

and a central portion connecting said first end and said second end;

an actuating beam having a series of downwardly depending extensions and coupled between said power source and said central portion of each of said operating members and an upwardly extending extension;

and a curved link coupling said central portion of one of said operating members to one of said downwardly depending extensions of said actuating beam;

and at least one reversing linkage connected to a door, said linkage comprising:

a first curved lever coupled to at least one of said operating members;

a pivot shaft, fixed to said center sill;

a second reversing lever mounted for rotation about said pivot shaft and coupled to said first lever at one end;

and a third lever rotatably coupled at one end to said second reversing lever and at its other end to said upwardly extending extension of said actuating beam;

wherein when said power source is activated, said operating members rotate such that connecting links, between said operating members and said doors, rotate said doors from said first closed position to said second open position.

2. The car of claim 1, wherein said actuating beam is located within said center sill.

3. The car of claim 1, wherein said power source comprises and air cylinder.

4. The car of claim 1, wherein said power source is located at said first end of said railroad hopper car.

5. The car of claim 1, wherein said power source is located at said second end of said railroad hopper car.

6. The car of claim 1, wherein the cooperation between each operating member and a corresponding one of said connecting links in the closed position creates an over center latch to positively lock the door.

* * * * *